US006419765B1

(12) United States Patent
Jackson et al.

(10) Patent No.: US 6,419,765 B1
(45) Date of Patent: Jul. 16, 2002

(54) NIOBIUM-SILICIDE BASED COMPOSITES RESISTANT TO LOW TEMPERATURE PESTING

(75) Inventors: Melvin Robert Jackson, Niskayuna; Bernard Patrick Bewlay, Schenectady; Ji-Cheng Zhao, Niskayuna, all of NY (US)

(73) Assignee: General Electric Company, Niskayuna, NY (US)

( * ) Notice: Subject to any disclaimer, the term of this patent is extended or adjusted under 35 U.S.C. 154(b) by 41 days.

(21) Appl. No.: 09/735,769

(22) Filed: Dec. 13, 2000

(51) Int. Cl.[7] ..... C22C 27/02
(52) U.S. Cl. ..... 148/422; 420/426
(58) Field of Search ..... 148/422; 420/426

(56) References Cited

U.S. PATENT DOCUMENTS

| | | | | |
|---|---|---|---|---|
| 5,393,487 A | | 2/1995 | Matway et al. | |
| 5,741,376 A | | 4/1998 | Subramanian et al. | |
| 5,833,773 A | | 11/1998 | Bewlay et al. | |
| 5,932,003 A | | 8/1999 | Jackson et al. | |
| 5,932,033 A | * | 8/1999 | Jackson et al. | 148/422 |
| 5,942,055 A | | 8/1999 | Jackson et al. | |

OTHER PUBLICATIONS

M. R. Jackson, et al, High–Temperature Refractory Metal–Intermetallic Composites, *Journal of Metals*, Jan., 1996.

B. P. Bewlay, et al., Refractory Metal–Intermetallic In–Situ Composites for Aircraft Engines, Reprinted from *JOM*, vol. 49, No. 8, Aug., 1997, pp. 44–45; p. 67.

B. P. Bewlay, et al., Evidence for the Existence of $Hf_5Si_3$, *Journal of Phase Equilibria*, vol. 20, No. 2, 1999.

B. P. Bewlay, et al., Processing High–Temperature Refractory–Metal Silicide In–Situ Composites, Reprinted from *JOM*, vol. 51, No. 4, Apr., 1999, pp. 32–36.

P. R. Subramanian, et al., Compressive Creep Behavior of $Nb_5Si_3$, *Scripta Metallurgica et Materialia*, vol. 32, No. 8, pp. 1227–1232, 1995.

B. P. Bewlay, et al., The Nb–Ti–Si Ternary Phase Diagram: Evaluation of Liquid–Solid Phase Equilibria in Nb–and Ti–Rich Alloys, *Journal of Phase Equilibria*, vol. 18, No. 3, 1997.

B. P. Bewlay, et al., The Nb–Hf–Si Ternary phase Diagram: Liquid–Solid Phase Equilibria in Nb–0 and Hf–rich Alloys, *z. Metallkd*, 90, 1999.

B. P. Bewlay, et al., The Nb–Ti–Si Ternary Phase Diagram: Determination of Solid–State Phase Equilibria in Nb–and Ti–Rich Alloys, *Journal of Phase Equilibria*, vol. 19, No. 6, 1998.

* cited by examiner

*Primary Examiner*—Sikyin Ip
(74) *Attorney, Agent, or Firm*—Robert P. Santandrea; Noreen C. Johnson

(57) ABSTRACT

A niobium-silicide refractory metal intermetallic composite having enhanced material characteristics, such as oxidation resistance, creep resistance, and toughness, and turbine components made therefrom. The composite comprises between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 atomic percent and about 3 atomic percent tin; up to about 2 atomic percent tungsten; up to about 2 atomic percent molybdenum; and a balance of niobium, wherein a ratio of a sum of atomic percentages of niobium and tantalum present in said niobium silicide refractory intermetallic composite to a sum of atomic percentages of titanium and hafnium present in said niobium silicide refractory intermetallic composite has a value between about 1.4 and about 2.2 (i.e.,1.4<(Nb+Ta):(Ti+Hf) <2.2).

23 Claims, No Drawings

NIOBIUM-SILICIDE BASED COMPOSITES RESISTANT TO LOW TEMPERATURE PESTING

This invention was made with Government support under Contract No. F33615-98-C-5215, awarded by the United States Air Force, Department of Defense, and the United States Government therefore has certain rights in the invention.

BACKGROUND OF THE INVENTION

The invention relates to Niobium (Nb)-silicide based composite compositions. In particular, the invention relates to Nb-silicide based composite compositions with chemistries that permit the Nb-silicide based composite compositions to find applications in turbine components.

Turbines and their components (hereinafter "turbine components"), such as, but not limited to, aeronautical turbines, land-based, turbines, marine-based turbines, and the like, have typically been formed from nickel (Ni)-based materials, which are often referred to as Ni-based superalloys. Turbine components formed from these Ni-based superalloys exhibit desirable chemical and physical properties under the high temperature, high stress, and high-pressure conditions generally encountered during turbine operation. For example, turbine components, such as an airfoil, in modern jet engines can reach temperatures as high as about 1,150° C., which is about 85% of the melting temperatures ($T_m$) of most Ni-based superalloys.

Because Ni-based superalloys have provided the level of performance desired in such applications, the development of such Ni-based superalloys has been widely explored. Consequently, the field has matured and few significant improvements have been realized in this area in recent years. In the meantime, efforts have been made to develop alternative turbine component materials. These alternate materials include niobium (Nb)-based refractory metal intermetallic composites (hereinafter "RMIC"s). Most RMICs have melting temperatures of about 1700° C. If RMICs can be used at about 80% of their melting temperatures, they will have potential use in applications in which the temperature exceeds the current service limit of Ni-based superalloys.

RMICs comprising at least niobium (Nb), silicon (Si), titanium (Ti), hafnium (Hf), chromium (Cr), and aluminum (Al) have been proposed for turbine component applications. These silicide-based RMICs exhibit a high temperature capability that exceeds that of current Ni-based superalloys. Exemplary silicide-based RMICs are set forth in U.S. Pat. No. 5,932,033, to M. R. Jackson and B. P. Bewlay, entitled "Silicide Composite with Nb-Based Metallic Phase and Si-Modified Laves-Type Phase" and U.S. Pat. No. 5,942,055, to Jackson and Bewlay, entitled "Silicide Composite with Nb-Based Metallic Phase and Si-Modified Laves-Type Phase".

Some known Nb-silicide based composites—including silicide-based RMJCs—possess adequate oxidation resistance characteristics for turbine applications. These materials have compositions within the following approximate ranges. 20–25 atomic percent titanium (Ti), 1–5 atomic percent hafnium (Hf), and 0–2 atomic percent tantalum (Ta), where the concentration ratio (Nb+Ta):(Ti+Hf) has a value of about 1.4; 12–21 atomic percent silicon (Si), 2–6 atomic percent germanium (Ge), and 2–5 atomic percent boron (B), where the sum of the Si, B, and Ge concentrations is in the range between 22 atomic percent and 25 atomic percent; 12–14 atomic percent chromium (Cr) and 0–4 atomic percent iron (Fe), where the sum of the Fe and Cr concentrations is between 12 atomic percent and 18 atomic percent; 0–4 atomic percent aluminum (Al); 0–3 atomic percent tin (Sn); and 0–3 atomic percent tungsten (W). Other known Nb-based silicide composites—including silicide-based RMIC materials—have adequate creep-rupture resistance for turbine component applications. These materials have compositions within the following approximate ranges: 16–20 atomic percent Ti, 1–5 atomic percent Hf, and 0–7 atomic percent Ta, where the concentration ratio (Nb+Ta):(Ti+Hf) has a value of about 2.25; 17–19 atomic percent Si, 0–6 atomic percent Ge, and 0–5 atomic percent B, where the sum of the Si, B, and Ge concentrations is in the range between 17 atomic percent and 21 atomic percent; 6–10 atomic percent Cr and 0–4 atomic percent Fe, where the sum of the Fe and Cr concentrations is in the range between 6 atomic percent and 12 atomic percent; 0–4 atomic percent Al; 0–3 atomic percent Sn; 0–3 atomic percent W; and 0–3 atomic percent Mo. In addition, other known Nb-silicide based composites—including silicide-based RMIC materials—have adequate fracture toughness for turbine component applications. These materials contain greater than or equal to about 30 volume percent of metallic phases present in such components.

Although the above Nb-silicide based composite alloys and Nb-silicide based RMIC materials possess beneficial mechanical and chemical properties, they do not adequately balance oxidation resistance properties with toughness and creep resistance properties. Thus, a single Nb-silicide based RMIC alloy material composition that can provide adequate creep, oxidation resistance, and toughness for turbine component applications is currently not available.

While the oxidation performance and creep-rupture resistance for turbine component applications of known RMICs are desirable, these materials and their properties may still be further improved for turbine component applications. For example, the chemistries and compositions of the RMIC material may be modified to enhance oxidation resistance for applications that subject the turbine component to high stresses at temperatures ranging from about 1300° F. to about 1700° F. (about 700° C. to about 925° C.) over extended periods of time.

Therefore, what is needed is a Nb-silicide based RMIC material having a composition, chemistry, and properties that are suitable for various applications such as, but not limited to, turbine components, in which high stresses at elevated temperatures are encountered over long periods of time.

SUMMARY OF THE INVENTION

Accordingly, one aspect of the present invention is to provide a turbine having at least one component formed from a niobium silicide refractory intermetallic composite comprising: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 and about 3 atomic percent tin; up to about 2 atomic percent tungsten; up to about 2 atomic percent molybdenum; and a balance of niobium.

A second aspect of the present invention is to provide a niobium silicide refractory intermetallic composite adapted for use in a turbine component. The niobium silicide refractory intermetallic composite comprises: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 and about 3 atomic percent tin; up to about 2 atomic percent tungsten; up to about 2 atomic percent molybdenum; and a balance of niobium, wherein a ratio of a sum of atomic percentages of niobium and tantalum present in the niobium silicide refractory intermetallic composite to a sum of atomic percentages of titanium and hafnium present in the niobium silicide refractory intermetallic composite has a value between about 1.4 and about 2.2 (i.e., $1.4<(Nb+Ta):(Ti+Hf)<2.2$).

A third aspect of the present invention is to provide a turbine component formed from a niobium silicide refractory intermetallic composite, comprising: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 and about 3 atomic percent tin; up to about 2 atomic percent tungsten; up to about 2 atomic percent molybdenum; and a balance of niobium.

DETAILED DESCRIPTION OF THE INVENTION

Refractory materials can undergo a type of oxidation often referred to as a "pesting" at temperatures in a range from about 1300° F. (about 700° C.) to about 1700° F. (about 925° C.). This type of refractory material oxidation is characterized by the inability of a slow-growing, protective oxide scale to form, due to kinetics of diffusion, which are characteristically slow for these materials in this temperature range. As a result of the lack of such a protective scale, oxygen can penetrate the refractory material structure at both interfacial regions and through the lattice structure of the material, thus embrittling the underlying substrate. The embrittled layer can fracture during thermal cycling. Such fracture leads to rapid material loss and ultimately causes the structure of the refractory material to disintegrate.

As disclosed in the present invention, the oxidation characteristics of refractory materials can be enhanced by the addition of several elements that have additional metallic and Laves-type phases. In the present invention, Laves-type phases preferably comprise up to about 20 volume percent of the Nb-silicide RMICs. Metallic phases preferably comprise at least 25 volume percent of the Nb-silicide RMICs. For example, if the titanium (Ti) content in a refractory material is maintained at a certain level, the performance and characteristics of the refractory material can be improved. If at least one of germanium (Ge) and tin (Sn) are added to the refractory material, the loss of refractory material due to pesting oxidation can be reduced.

In the present invention, a niobium (Nb)-silicide based alloy composite comprising a Nb-silicide refractory metal intermetallic composite (hereinafter "RMIC"s), which overcomes the undesirable refractory material characteristic of pesting type oxidation, is described. The Nb-silicide RMIC described herein possesses a composition that provides the necessary balance between oxidation characteristics and mechanical properties. The Nb-silicide RMIC comprises: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 and about 3 atomic percent tin; up to about 2 atomic percent tungsten; up to about 2 atomic percent molybdenum; and a balance of niobium. In one embodiment of the present invention, the ratio of a sum of atomic percentages of niobium and tantalum present in the niobium silicide refractory intermetallic composite to a sum of atomic percentages of titanium and hafnium present in the niobium silicide refractory intermetallic composite has a value between about 1.4 and about 2.2 (i.e., $1.4<(Nb+Ta):(Ti+Hf)<2.2$). The atomic percent values given for each element are approximate unless otherwise specified.

Nb-silicide RMICs, as embodied by the invention, exhibit oxidation and rupture resistance characteristics provided by the addition of titanium (Ti), geranium (Ge) and Tin (Sn). The Nb-silicide RMICs disclosed in the present invention can be used to form turbine components such as, but not limited to, buckets, blades, rotors, nozzles, and the like for applications in land-based turbines, marine turbines, aeronautical turbines, power generation turbines, and the like.

Example 1

A series of Nb-silicide RMIC samples of the present invention were prepared by arc casting tapered disks having a thickness of about 0.8" and a diameter tapering from about 2.5" to about 3". Pins having a diameter of about a 0.12" and a length of about a 1.25" were prepared by conventional machining processes, such as EDM and centerless grinding. The pins were then subjected to 200 hours exposure (hot time) with a total test exposure of about 234 hours in one-hour cycles. The heating cycles were followed with cooling to room temperature after each hour of hot time at either 1400° F. (760° C.) or 1600° F. (870° C.).

The Nb-silicide RMIC samples were weighed before, periodically during, and after testing to determine an average weight change of each sample per unit area as a function of exposure time. Each sample was then cut at its approximate mid-section and prepared for metallographic evaluation of changes in diameter and in microstructure. Evaluation of the samples was not necessarily limited to a metallographic examination.

Results of the weight change (listed in columns labeled 'wt') and metallographic measurements of diameter changes (listed in columns labeled 'mil') obtained at completion of the test are listed as a function of sample composition for a series of Nb-silicide RMICs in Table 1. The atomic percentages listed in Table 1 are approximate Values for the (Nb+Ta):(Ti+Hf) ratio are also provided.

TABLE 1

CYCLIC OXIDATION RESULTS FOR ARC CAST COMPOSITE ALLOYS

| Sample | ratio | Nb | Ti | Hf | Si | Al | Cr | B | Ta | Ge | Mo | W | Sn | Fe | 1400 wt | 1400 mil | 1600 wt | 1600 mil |
|---|---|---|---|---|---|---|---|---|---|---|---|---|---|---|---|---|---|---|
| A1 | 1.5 | 41.0 | 23.0 | 4 | 17 | 2 | 13 | | | | | | | | −110 | −10 | −249 | −15 |
| A2 | 1.5 | 38.5 | 21.5 | 4 | 17 | 2 | 13 | 4 | | | | | | | −38 | −1 | −239 | −21 |
| A3 | 1.5 | 35.0 | 23.0 | 4 | 17 | 2 | 13 | | 6 | | | | | | −94 | −2 | dust | −60 |
| A4 | 1.5 | 41.0 | 23.0 | 4 | 12 | 2 | 13 | | | 5 | | | | | −239 | 1 | −70 | 0 |
| A5 | 1.5 | 40.5 | 22.5 | 4 | 17 | 2 | 13 | | | | 1 | | | | −185 | −1 | −183 | −12 |
| A6 | 1.5 | 40.5 | 22.5 | 4 | 17 | 2 | 13 | | | | | 1 | | | −136 | −1 | −232 | −9 |
| A7 | 1.5 | 40.0 | 22.5 | 4 | 17 | 2 | 13 | | | | | | 1.5 | | −31 | 0 | −75 | −4 |
| A8 | 1.5 | 40.0 | 22.5 | 4 | 17 | 2 | 13 | | | | | | | 2 | −10 | 1 | −222 | −16 |
| A9 | 1.5 | 42.5 | 23.5 | 4 | 17 | | 13 | | | | | | | | −260 | −1 | −401 | −26 |
| A10 | 1.5 | 42.5 | 25.5 | 2 | 17 | | 13 | | | | | | | | −22 | −3 | dust | −60 |
| A11 | 2.5 | 48.5 | 15.5 | 4 | 17 | 2 | 13 | | | | | | | | −307 | −4 | dust | −60 |
| A12 | 2.5 | 46.0 | 14.0 | 4 | 17 | 2 | 13 | 4 | | | | | | | −15 | −4 | −399 | −33 |
| A13 | 2.5 | 42.5 | 15.5 | 4 | 17 | 2 | 13 | | 6 | | | | | | xx | xx | xx | xx |
| A14 | 2.5 | 48.5 | 15.5 | 4 | 12 | 2 | 13 | | | 5 | | | | | −276 | 5 | dust | −60 |
| A15 | 2.5 | 48.0 | 15.0 | 4 | 17 | 2 | 13 | | | | 1 | | | | −140 | −6 | dust | −60 |
| A16 | 2.5 | 48.0 | 15.0 | 4 | 17 | 2 | 13 | | | | | 1 | | | −455 | −1 | dust | −60 |
| A17 | 2.5 | 47.5 | 15.0 | 4 | 17 | 2 | 13 | | | | | | 1.5 | | −32 | 0 | dust | −60 |
| A18 | 2.5 | 47.5 | 15.0 | 4 | 17 | 2 | 13 | | | | | | | 2 | −75 | −3 | −480 | xx |
| A19 | 2.5 | 50.0 | 16.0 | 4 | 17 | | 13 | | | | | | | | dust | −60 | dust | −60 |
| A20 | 2.5 | 50.0 | 18.0 | 2 | 17 | | 13 | | | | | | | | −70 | −4 | dust | −60 |
| A21 | 1.5 | 32.5 | 23.0 | 2 | 17 | | 13 | 4 | 6 | | 1 | | | 2 | 5 | 2 | −245 | −13 |
| A22 | 1.5 | 29.5 | 21.0 | 2 | 17 | | 13 | 4 | 6 | 5 | | 1 | 1.5 | | 3 | −1 | 5 | 2 |
| A23 | 1.5 | 40.5 | 22.5 | 4 | 20 | | 13 | | | | | | | | −33 | −2 | −319 | −22 |
| A24 | 1.5 | 40.5 | 22.5 | 4 | 15 | | 13 | | | 5 | | | | | 3 | 1 | −205 | −10 |
| A25 | 1.5 | 39 | 24 | 2 | 15 | 2 | 10 | | | 5 | | | | 3 | | | | |
| A26 | 2.0 | 43.3 | 19.7 | 2 | 15 | 2 | 10 | | | 5 | | | | 3 | | | | |

Formation of a hexagonal $M_5Si_3$ silicide (where M is titanium, hafnium, or combinations thereof), which has been found to be detrimental to creep resistance, is aided when the (Nb+Ta):(Ti+Hf) ratio of the Nb-silicide RMIC has a value of less than 1.5. Values for the ratio (Nb+Ta):(Ti+Hf) are reported in Table 1. Samples A4, A7, and A22, which represent the preferred Nb-silicide RMIC compositions of the present invention, exhibited relatively small radius changes in the range from about +2 to about −4 mils (about +50 to about −100 microns) at both 1400° F. and 1600° F. A weight change occurring with little change in radius in a refractory material alloy is indicative of oxidation attack a t the ends of the sample. This type of oxidation leads to rounding of the sample edges, even though radial attack on the pin is small. An increase in pin radius from its initial size can be attributed to oxygen uptake by the refractory material sample. Any near-surface cracking that may occur can also lead to an increase in the radius of the refractory material.

The data in the Table 1 for the 1600° F. cyclic exposures demonstrates that most refractory material alloys can be adversely influenced by oxidation at this temperature. Most of the refractory material alloys samples having a (Nb+Ta):(Ti+Hf) ratio of 2.5 did not survive the 200 hours of hot time. Based on these results, the Ti content should preferably be greater than about 18 atomic percent in order for a Nb-silicide based RMIC to survive at about 1600° F. In order to achieve an adequate level of refractory material oxidation resistance to pesting, additions of at least one of Ge and Sn can be made to RMICs containing Ti. Germanium and tin levels in the samples were about 5 atomic percent and about 1.5 atomic percent, respectively. Tin and germanium may, however, be present in other concentrations that are within the range described in the present invention.

While various embodiments are described herein, it will be appreciated from the specification that various combinations of elements, variations or improvements therein may be made by those skilled in the art, and are within the scope of the invention.

What is claimed is:

1. A turbine having at least one turbine component formed from a niobium silicide refractory intermetallic composite, said niobium silicide refractory intermetallic composite comprising: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 atomic percent and about 3 atomic percent tin; up to about 2 atomic percent tungsten; up to about 2 atomic percent molybdenum; and a balance of niobium.

2. The turbine of claim 1, wherein a ratio of a sum of atomic percentages of niobium and tantalum present in said niobium silicide refractory intermetallic composite to a sum of atomic percentages of titanium and hafnium present in said niobium silicide refractory intermetallic composite has a value between about 1.4 and about 2.2.

3. The turbine of claim 2, wherein said turbine component is a component selected from the group consisting of a bucket, a blade, a rotor, and a nozzle.

4. The turbine of claim 2, wherein said turbine is a turbine selected from the group consisting of land-based turbines, marine turbines, aeronautical turbines, and power generation turbines.

5. A niobium silicide refractory intermetallic composite adapted for use in a turbine component, said niobium silicide refractory intermetallic composite comprising: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 and about 3 atomic percent tin; up to about 2 atomic percent tungsten; up to about 2 atomic percent molybdenum; and a balance of niobium, wherein a ratio of a sum of atomic percentages of niobium and tantalum present in said niobium silicide refractory intermetallic composite to a sum of atomic percentages of titanium and hafnium present in said niobium silicide refractory intermetallic composite has a value between about 1.4 and about 2.2.

6. The niobium silicide refractory intermetallic composite of claim 5, wherein said niobium silicide refractory intermetallic composite comprises: about 23 atomic percent titanium; about 4 atomic percent hafnium; about 12 atomic percent silicon; about 5 atomic percent germanium; about 13 atomic percent chromium; about 2 atomic percent aluminum; and the balance niobium, and wherein: said ratio has a value of about 1.5.

7. The niobium silicide refractory intermetallic composite of claim 5, wherein said niobium silicide refractory intermetallic composite comprises: about 22.5 atomic percent titanium; about 4 atomic percent hafnium; about 17 atomic percent silicon; about 13 atomic percent chromium; about 2 atomic percent aluminum; about 1.5 atomic percent tin; and the balance niobium, and wherein said ratio has a value of about 1.5.

8. The niobium silicide refractory intermetallic composite of claim 5, wherein said niobium silicide refractory intermetallic composite comprises: about 21 atomic percent titanium; about 2 atomic percent hafnium; about 6 atomic percent tantalum; about 17 atomic percent silicon; about 5 atomic percent germanium; about 4 atomic percent boron; about 13 atomic percent chromium; about 1.5 atomic percent tin; about 1 atomic percent tungsten; and the balance niobium, and wherein said ratio has a value of about 1.5.

9. The niobium silicide refractory intermetallic composite of claim 5, wherein said niobium silicide refractory intermetallic composite includes at least one metallic phase, said metallic phase comprising at least 30 volume percent of said niobium silicide refractory intermetallic composite.

10. The niobium silicide refractory intermetallic composite of claim 5, wherein said niobium silicide refractory intermetallic composite includes at least one Laves phase, said Laves phase comprising up to about 20 volume percent of said niobium silicide refractory intermetallic composite.

11. The niobium silicide refractory intermetallic composite of claim 5, wherein said niobium silicide refractory intermetallic composite is resistant to pesting oxidation at temperatures in the range between about 1400° F. and about 1600° F.

12. The niobium silicide refractory intermetallic composite of claim 11, wherein a radius of a cylindrical sample formed from said niobium silicide refractory intermetallic composite changes less than about 6 mils when heated to about 1600° F. for 100 hours.

13. A turbine component formed from a niobium silicide refractory intermetallic composite, said niobium silicide refractory intermetallic composite comprising: between about 14 atomic percent and about 26 atomic percent titanium; between about 1 atomic percent and about 4 atomic percent hafnium; up to about 6 atomic percent tantalum; between about 12 atomic percent and about 22 atomic percent silicon; up to about 5 atomic percent germanium; up to about 4 atomic percent boron; between about 7 atomic percent and about 14 atomic percent chromium; up to about 3 atomic percent iron; up to about 2 atomic percent aluminum; between about 1 atomic percent and about 3 atomic percent tin; up to about 2 atomic percent tungsten; up to about 2 atomic percent molybdenum; and a balance of niobium.

14. The turbine component of claim 13, wherein a ratio of a sum of atomic percentages of niobium and tantalum present in said niobium silicide refractory intermetallic composite to a sum of atomic percentages of titanium, and hafnium present in said niobium silicide refractory intermetallic composite has a value of between about 1.4 and about 2.2.

15. The turbine component of claim 14, wherein said niobium silicide refractory intermetallic composite comprises: about 23 atomic percent titanium; about 4 atomic percent hafnium; about 12 atomic percent silicon; about 5 atomic percent germanium; about 13 atomic percent chromium; about 2 atomic percent aluminum; and the balance niobium, and wherein said ratio has a value of about 1.5.

16. The turbine component of claim 14, wherein said niobium silicide refractory intermetallic composite comprises: about 22.5 atomic percent titanium; about 4 atomic percent hafnium; about 17 atomic percent silicon; about 13 atomic percent chromium; about 2 atomic percent aluminum; about 1.5 atomic percent tin; and the balance niobium, and wherein said ratio has a value of about 1.5.

17. The turbine component of claim 14, wherein said niobium silicide refractory intermetallic composite comprises: about 21 atomic percent titanium; about 2 atomic percent hafnium; about 6 atomic percent tantalum; about 17 atomic percent silicon; about 5 atomic percent germanium; about 4 atomic percent boron; about 13 atomic percent chromium; about 1.5 atomic percent tin; about 1 atomic percent tungsten; and the balance niobium, and wherein said ratio has a value of about 1.5.

18. The turbine component of claim 14, wherein said turbine component is a component selected from the group consisting of a bucket, a blade, a rotor, and a nozzle.

19. The turbine component of claim 14, wherein said turbine component is a component of a turbine selected from the group consisting of land-based turbines, marine turbines, aeronautical turbines, and power generation turbines.

20. The turbine component of claim 14, wherein said niobium silicide refractory intermetallic composite includes at least one metallic phase, said metallic phase comprising at least 30 volume percent of said niobium suicide refractory intermetallic composite.

21. The turbine component of claim 14, wherein said niobium silicide refractory intermetallic composite includes at least one Laves phase, said Laves phase comprising up to about 20 volume percent of said niobium silicide refractory intermetallic composite.

22. The turbine component of claim 14, wherein said niobium silicide refractory intermetallic composite is resistant to pesting oxidation at temperatures in the range from between about 1400° F. to about 1600° F.

23. The turbine component of claim 22, wherein a radius of a cylindrical sample formed from said niobium silicide refractory intermetallic composite changes less than about 6 mils when heated to about 1600° F. for 100 hours.

* * * * *